US005500870A

United States Patent [19]

König et al.

[11] Patent Number: 5,500,870

[45] Date of Patent: Mar. 19, 1996

[54] PROCESS AND DEVICE FOR THE EXTRACTION OF VALUABLE SUBSTANCES

[75] Inventors: Heribert König, Duisburg; Heinz Stark, Essen, both of Germany

[73] Assignee: Mannesmann Aktiengesellschaft, Düsseldorf, Germany

[21] Appl. No.: 339,777

[22] Filed: Nov. 15, 1994

[30] Foreign Application Priority Data

Nov. 15, 1993 [DE] Germany ..... 43 39 226.1

[51] Int. Cl.[6] ..... F27D 23/00

[52] U.S. Cl. ..... 373/78; 373/9; 373/81; 75/10.3; 75/10.4

[58] Field of Search ..... 373/2, 9, 42–45, 373/72, 78, 79–81, 115, 121–123; 266/200, 227, 236; 75/10.19, 478, 499, 10.22, 10.23, 10.3, 10.4

[56] References Cited

U.S. PATENT DOCUMENTS

| | | | |
|---|---|---|---|
| 1,522,665 | 1/1925 | Wright | 373/79 |
| 2,254,809 | 9/1941 | Tharaldsen | 373/115 |
| 3,555,164 | 1/1971 | Kostin | 75/10.3 |
| 3,610,795 | 10/1971 | Antoine | 373/78 |
| 4,740,989 | 4/1988 | Steipe et al. | 373/2 |
| 5,406,579 | 4/1995 | Vallomy | 373/77 |

*Primary Examiner*—Tu Hoang

*Attorney, Agent, or Firm*—Cohen, Pontani, Lieberman, Pavane

[57] ABSTRACT

A process and melting furnace unit are provided for extracting valuable substances by reducing oxygen-bound metals which process includes exposing a charge in a first reaction zone of a furnace vessel to heat energy so that a liquid slag floats on a metal melting bath, feeding the metal bath to a second reaction zone of the furnace vessel where the slag comes intimately into contact with a reducing agent, and feeding additional heat energy to the melt in the second reaction zone to prevent hardening.

11 Claims, 2 Drawing Sheets

PROCESS AND DEVICE FOR THE EXTRACTION OF VALUABLE SUBSTANCES

BACKGROUND OF THE INVENTION

1. Field of the Invention

The invention relates to a process for the extraction of valuable oxygen-bound metals by reduction in metallurgical vessels. The invention further relates to a melting furnace unit with a separating wall which separates the vessel into two parts and extends from the furnace roof into the vessel. The furnace unit further has a device for supplying heat energy as well as devices for feeding material and melt removal, and a connection to a gas purification unit.

2. Description of the Prior Art

In metallurgical processes for extracting valuable oxygen-bound metals, such as lead or copper, by reduction, the reducing agent needed for the reduction process is usually provided by charging onto the molten bath. Because of the great difference in specific weight between the reducing agent, usually coke, and the metallurgical melt, which is to be equated with a slag melt, the reducing agent in the form of coke is only able to float as a top layer on the melt. This results in only slight effective contact of the reductant with the large volume of metallurgical oxidic bath to be reduced. The consequences of this poor contact are very long holding and reduction times (as long as days) with a considerable expenditure of holding energy.

In addition, a process is known from DE OS 25 09 061 in which material containing metal oxide is reduced in a glowing coke bed, which is shaped like a horizontal ring and heated electrically. In this process, which essentially serves to extract a metal melt containing carbon from material containing metal oxide, the melted metal is prevented from forming a coherent molten layer below the coke bed.

Along with the difficulty in controlling the prevention of the formation of a coherent molten layer below the coke bed, other disadvantages of this process include the use of an annular furnace with its large number of individual moving parts which are subject to wear.

A unit is known from DE 36 14 048 A1 which has a reactor filled with molten metal, in which a separating wall, which has at least one opening for the molten metal on the floor of the reactor, is located in the central area of the reactor. This unit is used for the gasification of inferior fuels in a molten metal melting bath, particularly an iron melting bath, and is not suitable for reducing an oxidic metallurgical melt of value. Inferior fuels, including used oil, household refuse, bulky refuse, waste materials, automobile tires, etc., are introduced here into the metal melt. The carbon contained in the inferior fuel, as well as the sulphur, pass into solution in the iron bath. The non-gasifiable and non-soluble components of the inferior fuels are slagged and immediately removed from the reactor chamber via the discharge organ. No intimate contact occurs here between a reducing agent and the slag melt.

SUMMARY OF THE INVENTION

Accordingly, it is an object of the present invention to provide a process for extracting valuable oxygen-bound metals, and to further provide a melting furnace unit for carrying out the process by way of which process and furnace unit the yield is increased while reduction time is simultaneously reduced.

Pursuant to this object, and others which will become apparent hereafter, one aspect of the present invention resides in a process for extracting valuable substances by reducing oxygen-bound metals, which process includes exposing a solid or liquid charge in a first reaction zone to heat energy until, in the case of the solid charge, a melting bath forms, or, in the case of the liquid charge, a melting bath is maintained so that liquid slag floats on the metal melting bath. The inventive method further including feeding the metal melting bath to a second reaction zone where the slag comes intimately into contact with a reducing agent, and then feeding additional heat energy to the melting bath in the second reaction zone to prevent chilling and hardening or freezing.

Another aspect of the invention resides in a melting furnace having a separating wall which separates the furnace vessel into two parts and extends downwardly into the vessel. The melting furnace unit further has device for supplying heat energy as well as additional devices for feeding material into the furnace and for removing melt from the furnace as well as for connecting the furnace vessel to a gas purifier. The separating wall is immersed into the slag and partitions off a part of the hearth room. The oxidic melt penetrates under the separating wall into the partitioned-off part of the hearth and rises there to the same vertical level.

The second furnace part is designed as a shaft and is filled with coke, specifically, to such a height that the weight of the coke column is great enough to overcome the lifting force of the oxidic bath and the coke is immersed over the entire height of the slag bath floating on the metal melt. This results in intimate effective contact between the reducing agent and the valuable metal oxides found in the melt. In this way, reduction is initiated and the reduced-out metal will collect below the valuable slag. The continuous flow-off of the extracted metal and the discontinuous tapping of depleted or reduced-out slag in the ground region of the reducing agent shaft result in a continuous flow of valuable oxidic slag to the reduction area of the hearth under the coke/reduction shaft.

In order to obtain the energy needed for the reduction process, electrodes, which are equipped with an electrical energy source, extend obliquely into the reducing agent shaft. When the electrodes are subjected to an electric voltage, a current flows from electrode to electrode through the electric resistance of the reducing agent producing the Joule heat necessary for the reduction process.

The gas which arises during reduction passes through the coke layers of the shaft in the direction opposite to the delivery direction of the coke. Any carbon dioxide produced in the course of the process is reduced by the reducing agent, so that, in sum, a high-quality combustible gas is obtained above the coke charge.

In an advantageous further embodiment, the gas produced in the first furnace part is passed through the separating wall into the reducing agent shaft. In the reducing agent shaft, this carbon dioxide is reduced by the reducing agent to gas of value. Another advantage is that the dust-load of the waste gas from the first furnace part is deposited in the coke framework and fed back into the process. This eases the burden on the gas purification system and increases the quantity of valuable gas.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

DETAILED DESCRIPTION OF THE PREFERRED EMBODIMENTS

Figure 1:
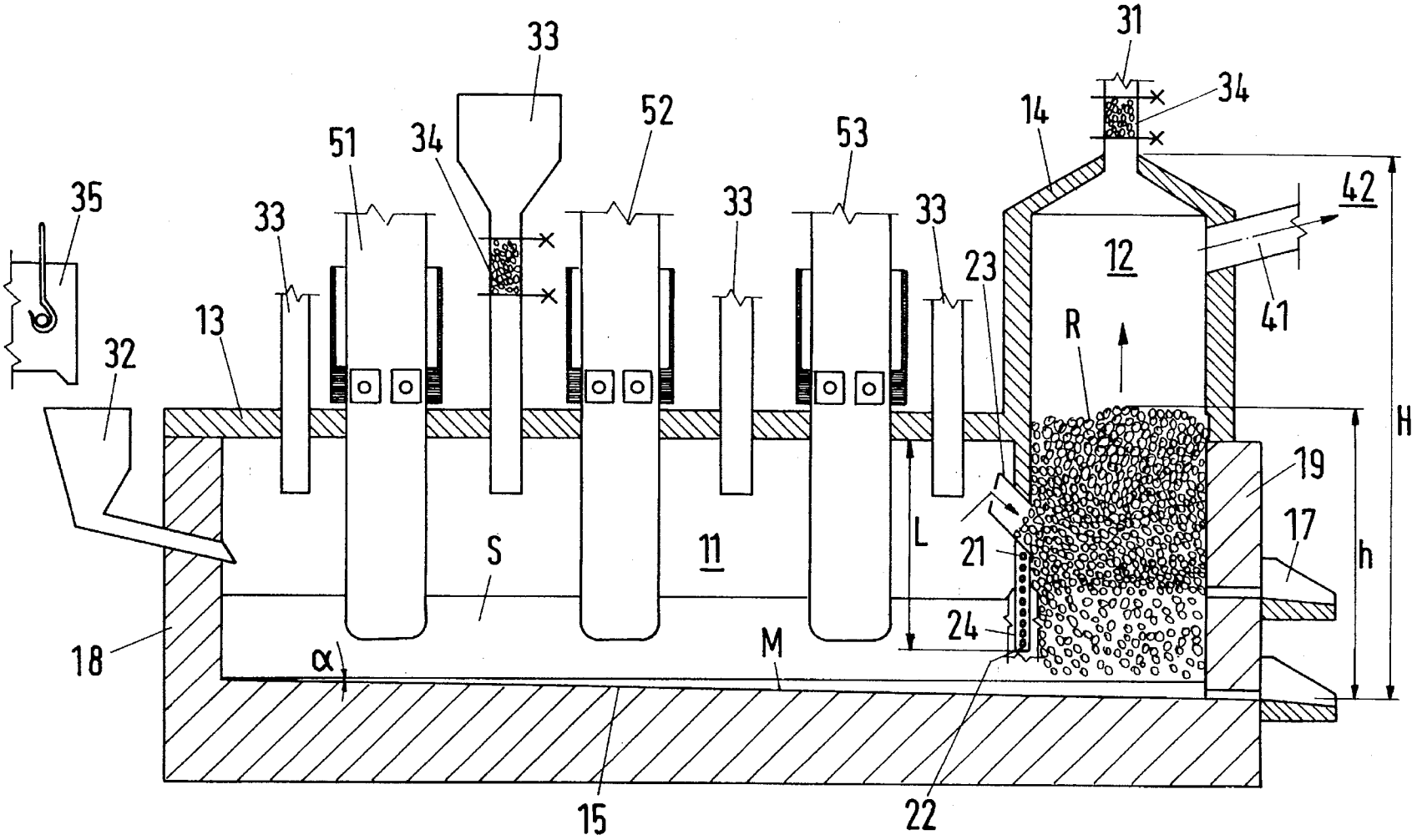
FIG. 1 shows a side view of the inventive melting furnace unit.

The drawings depict a first furnace part 11 and a second furnace part 12, which are connected to one another through a common vessel bottom 15. The first furnace part 11 is closed by a furnace roof 13, through which electrodes 51 to 53 and feed 33 pipes for feeding of solid charge are provided. In a side wall 18 of the first furnace part 11 there is a feed 32 for liquid charge, which can be operated by a ladle 35.

Between the first furnace part 11 and the shaft-like second furnace part 12 there is a separating wall 21. This separating wall 21 is of a length L which operates a mouth 22 whose distance from the vessel floor is wide enough so that during operation the separating wall 21 does not come into contact with molten metal M.

In the separating wall 21 there is an opening 23, through which the gas can make its way from within the first furnace part 11 into the second furnace part 12.

The part of the separating wall 21 which is immersed into the slag S during operation is equipped with cooling elements 24, through which a cooling agent can be conducted.

In a side wall 19 of the second furnace part 12, a tap 17 for slag S and a tap 16 for molten metal M are provided. The molten metal tap 16 is located at the same height as the vessel bottom 15, which declines from the side wall 18 at an angle of inclination $\propto$ of 1° to 7°.

The top end 14 of the shaft-like second furnace part 12 is a cover and has a feed 31 in its center for the reducing agent R. The reducing agent feed 31, like the solid charge feed 33, has a sluice 34, which prevents gas from flowing out of the furnace. In the area of the top end 14 of the second furnace part 12 there is a connection 41 to a gas purifier 42. The entire shaft of the furnace part 12 has a shaft height H, which is distinctly higher than the column height h of the reducing agent R.

Figure 2:
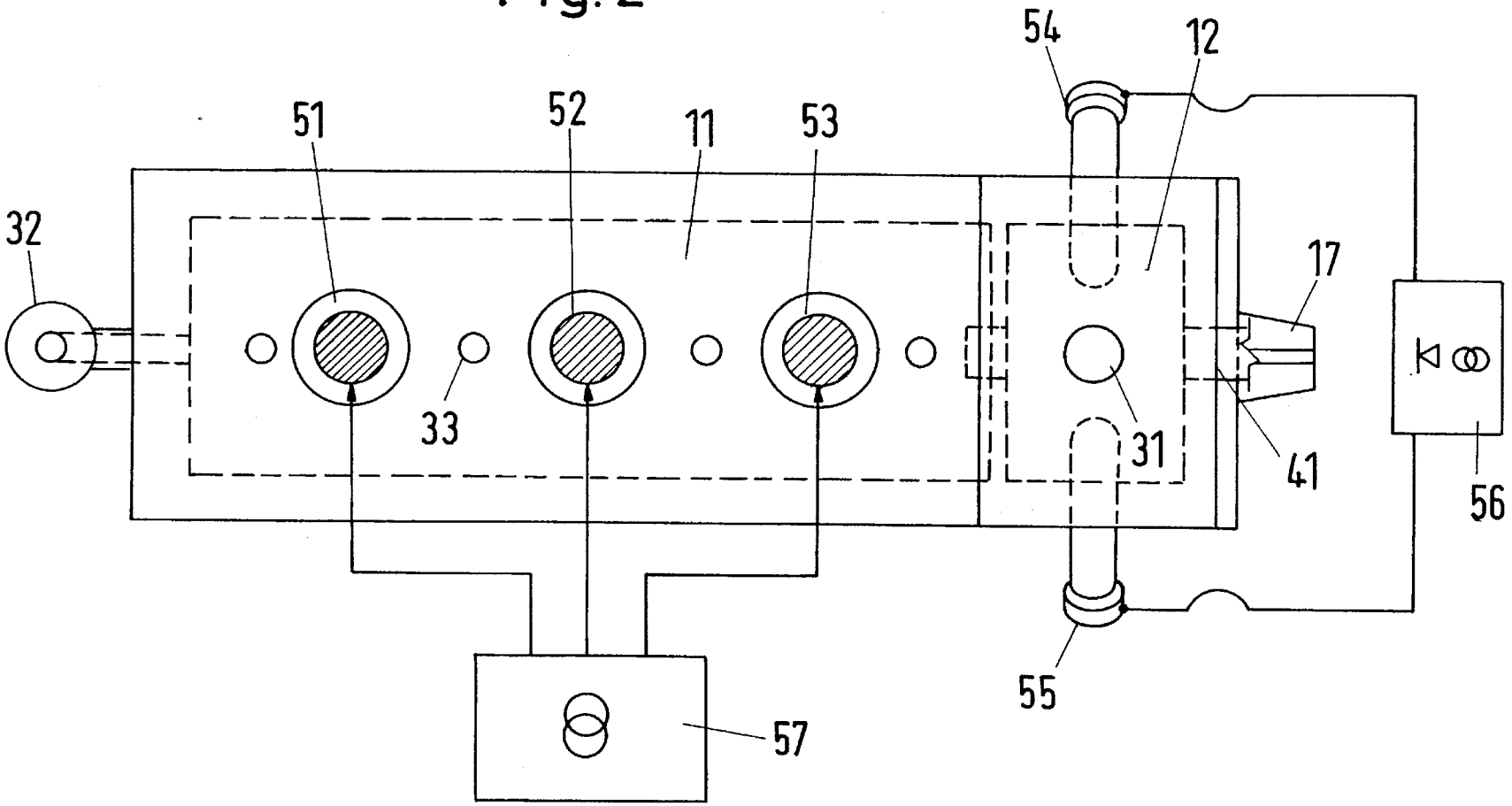
FIG. 2 shows a top view of FIG. 1.

FIG. 2 shows the position of burners 54, 55 (not shown in more detail in FIG. 1), which extend into the reducing agent R to above the slag level and are connected to a direct current energy device 56.

The electrodes 51 to 53 are connected to an alternating current energy device 57.

In order to operate the furnace unit, energy devices for other media for supplying heat are also possible.

The invention is not limited by the embodiments described above which are presented as examples only but can be modified in various ways within the scope of protection defined by the appended patent claims.

We claim:

1. A process for extracting valuable substances by reducing oxygen-bound metals, comprising the steps of: exposing a charge in a first reaction zone of a vessel to heat energy so that a liquid slag floats on a metal melting bath; feeding the metal bath to a second reaction zone of the vessel where the slag comes intimately into contact with a reducing agent; feeding additional heat energy to the melt in the second reaction zone to prevent hardening; and providing the reducing agent in the second reaction zone in a columnar form to a column height where weight of the column overcomes a lifting force of the liquid slag.

2. The process as defined in claim 1, wherein said exposing step includes exposing a solid charge to heat energy until a metal melting bath forms.

3. The process as defined in claim 1, wherein said exposing step includes exposing a liquid charge to heat energy so that a melt bath is maintained.

4. The process as defined in claim 1, including continuously tapping the metal melt and discontinuously tapping the slag after reducing.

5. The process as defined in claim 1, including conducting waste gas from the first reaction zone through the reducing agent, and purifying the waste gas together with nitric oxides of the second reaction zone after dissipation of sensible heat of the waste gas.

6. A process for extracting valuable substances by reducing oxygen-bound metals, comprising the steps of:

exposing a charge in a first reaction zone of a vessel to heat energy so that a liquid slag floats on a metal melting bath;

feeding the metal bath to a second reaction zone of the vessel where the slag comes intimately into contact with a reducing agent;

feeding additional heat energy to the melt in the second reaction zone to prevent hardening;

conducting waste gas from the first reaction zone through the reducing agent; and purifying the waste gas together with nitric oxides of the second reaction zone after dissipation of sensible heat of the waste gas.

7. A melting furnace unit for reducing oxygen-bound metals to extract valuable substances, comprising: a furnace vessel; a roof member over the furnace vessel; a separating wall arranged so as to extend from the roof member into the vessel to separate the furnace vessel into a first part and a second part; means for supplying heat energy to the first vessel part; means for feeding charge material to the furnace vessel for melting to form slag and molten metal; means for removing melt from the furnace vessel; means for connecting the second part of the furnace vessel to a gas purifier, the separating wall having a length from the roof member so as to define a separating wall mouth that extends into the slag during a melting operation to a point near an upper level of the molten metal, the separating wall further having an opening defined therein which passes from the first furnace vessel pan to the second furnace vessel part near the roof member, the second furnace vessel pan having a shaft-like form with a shaft height which extends above a height of a column of reducing agent in the second furnace part, and a top end at which the gas purifier connection means is provided; burners arranged and adapted to extend laterally into the second vessel furnace part in a region above the melt; and means for supplying energy to the burners.

8. A melting furnace unit as defined in claim 7, wherein the opening in the separating wall is adapted to have a size through which gas flows from the first furnace vessel part to the second furnace vessel part without permitting said reducing agent to pass from the second furnace vessel part to the first furnace vessel part.

9. A melting furnace unit as defined in claim 7, and further comprising means for cooling a portion of the separating wall which is immersed in the slag during the melting operation.

10. A melting furnace unit as defined in claim 7, and further comprising means for feeding the reducing agent to the second furnace vessel part, said reducing agent feeding means being provided at a top end of the second furnace vessel part above the gas purifier connection means, and including a sluice.

11. A melting furnace unit as defined in claim 7, and further comprising a tap arranged at a bottom of the second furnace vessel part, the first and second furnace vessel parts having a common bottom adapted to decline toward the tap at an angle of inclination of between 1° and 7°.

* * * * *